US005645782A

United States Patent [19]

Howell et al.

[11] Patent Number: 5,645,782

[45] Date of Patent: Jul. 8, 1997

[54] PROCESS FOR MAKING POLY (TRIMETHYLENE TEREPHTHALATE) BULKED CONTINUOUS FILAMENTS

[75] Inventors: James Milton Howell, Greenville, N.C.; Wae-Hai Tung, Seaford, Del.; Frank Werny, West Chester, Pa.

[73] Assignee: E. I. Du Pont de Nemours and Company, Wilmington, Del.

[21] Appl. No.: 497,585

[22] Filed: Jun. 30, 1995

Related U.S. Application Data

[62] Division of Ser. No. 268,585, Jun. 30, 1994, abandoned.

[51] Int. Cl.[6] ..... D01D 5/092; D01F 6/62; D02G 1/16

[52] U.S. Cl. ..... 264/103; 28/271; 264/130; 264/168; 264/210.2; 264/210.8; 264/211.12; 264/211.14; 264/211.15; 264/211.17

[58] Field of Search ..... 264/103, 130, 264/168, 210.2, 210.8, 211.12, 211.14, 211.15, 211.17; 28/271; 57/289, 350

[56] References Cited

U.S. PATENT DOCUMENTS

| | | | |
|---|---|---|---|
| 3,169,296 | 2/1965 | Clendening, Jr. | 28/257 |
| 3,350,871 | 11/1967 | Pierce et al. | 57/245 |
| 3,525,134 | 8/1970 | Coon | 28/273 |
| 3,584,103 | 6/1971 | Harris | 264/168 |
| 3,681,188 | 8/1972 | Harris | 428/371 |
| 3,686,848 | 8/1972 | Miller et al. | 264/168 X |
| 3,803,453 | 4/1974 | Hull | 361/220 |
| 3,861,133 | 1/1975 | Frankfort et al. | 57/246 |
| 3,968,638 | 7/1976 | Norton et al. | 57/247 |
| 3,984,600 | 10/1976 | Kawase et al. | 428/364 |
| 4,164,114 | 8/1979 | Yabuki et al. | 57/236 |
| 4,295,329 | 10/1981 | Windley | 57/245 |
| 4,399,084 | 8/1983 | Sagawa et al. | 264/450 |
| 4,410,473 | 10/1983 | Iohara et al. | 264/103 |
| 4,454,196 | 6/1984 | Iohara et al. | 428/364 |
| 4,475,330 | 10/1984 | Kimura et al. | 428/364 |
| 4,517,315 | 5/1985 | Matsumura et al. | 521/64 |
| 4,820,566 | 4/1989 | Heine et al. | 428/88 |
| 4,877,572 | 10/1989 | Clarke et al. | 264/103 X |

FOREIGN PATENT DOCUMENTS

| | | |
|---|---|---|
| 547553 | 6/1993 | European Pat. Off. . |
| 578079 | 6/1946 | United Kingdom . |
| 1075689 | 7/1965 | United Kingdom . |
| 1254826 | 11/1971 | United Kingdom . |

OTHER PUBLICATIONS

Translation of Japan 52–5,320 (Published Jan. 17, 1977).
Translation of Japan 52–8,123 (Published Jan. 21, 1977).
Translation of Japan 52–8,124 (Published Jan. 21, 1977).
Translation of Japan 58–104,216 (Published Jun. 21, 1983).
Translation of Japan 57–193,534 (Published Nov. 27, 1982).
Translation of Japan 63–59,412 (Published Mar. 15, 1988).
Chemical Fibers International, vol. 45, Apr. 1995–"Mechanical Properties of Fibers Made of Polytrimethylene Terephthalate", H.L. Traub et al.
Journal of Polymer Science, vol. 14,263–274 (1976)–"The Mechanical Properties and Structure of Poly(m–methylene Terephthalate) Fibers", I.M. Ward et al.
Chemiefasern/Textilind, 41/93, 786–94 (1991), "Experience with Polyester Fibers in Tufted Articles of Heat–Set Yarns" H. Modlich, Berlin.

*Primary Examiner*—Leo B. Tentoni

[57] ABSTRACT

Polyester carpets of poly(trimethylene terephthalate) are disclosed which have excellent stain-resistance, texture retention and resistance to crushing. The bulked continuous filament yarn used to make the carpets and the process for making the yarns are also disclosed.

10 Claims, 2 Drawing Sheets

PROCESS FOR MAKING POLY (TRIMETHYLENE TEREPHTHALATE) BULKED CONTINUOUS FILAMENTS

This is a division of application Ser. No. 08/268,585, filed Jun. 30, 1994, now abandoned.

FIELD OF THE INVENTION

This invention relates to the process for manufacturing bulked continuous filaments of poly(trimethylene terephthalate), to the resulting filaments and to carpets made from the bulked filaments.

BACKGROUND OF THE INVENTION

Carpets which are resistant to staining by common food dyes are currently in high demand. In order to be stain-resistant, nylon carpets must either be treated with a stain-resist chemical or the nylon fibers must have a stain-resist agent incorporated within the polymer.

However, carpets made from polyester fibers have the benefit of the natural stain-resistant properties of polyester. Polyester carpets are commonly made from filaments of poly(ethylene terephthalate). These carpets may have poor crush resistance (also called pile height retention) and poor texture retention (i.e., the yarns in the tuft tips unravel with wear). Carpets may develop a matted appearance in areas of high foot traffic.

Polyester carpets have also been made from filaments of poly(butylene terephthalate). While these carpets may have improved resistance to crushing vs. carpets of poly(ethylene terephthalate), the carpets may exhibit poor initial texture and poor texture retention.

It would therefore be useful to have a polyester carpet which has natural, built-in stain-resistance and, at the same time, adequate texture retention and resistance to crushing.

SUMMARY OF THE INVENTION

One embodiment of the present invention is a carpet made from bulked continuous filament (BCF) yarn of poly (trimethylene terephthalate). The carpets have built-in stain-resistance and a texture retention and resistance to crushing which is superior to that of carpets made from similar BCF yarns of poly(ethylene terephthalate) or poly(butylene terephthalate).

The carpets of this invention are tufted with crimped ply-twisted yarns made from multiple bulked continuous filaments having randomly spaced 3-dimensional curvilinear crimp, a boil off bundle crimp elongation (BCE) (as later defined herein) between 20–95 percent and a shrinkage (as later defined herein) from 0 to 5 percent. The filaments are made from poly(trimethylene terephthalate) having an intrinsic viscosity between about 0.6 to 1.3.

A second embodiment of this invention is the poly (trimethylene terephthalate) BCF yarn used to make the carpets of this invention. The bulked continuous filament yarns of this invention have an intrinsic viscosity between 0.6 to 1.3, a boil off BCE between 20 to 95 percent, a shrinkage from 0 to 5 percent, a denier per filament between 4 and 25 and a total denier between 700 and 5000. Tenacity is in the range of 1.2 to 3.5 grams per denier (gpd) and break elongation is between 10 to 90 percent, preferably 20 to 70 percent.

A third embodiment of this invention is the process for manufacturing the BCF yarn. The overall process comprises the steps of:

a) extruding molten poly(trimethylene terephthalate) polymer at a temperature between 245° C. to 285° C. through a spinneret to form filaments, said poly (trimethylene terephthalate) polymer having an intrinsic viscosity in the range of 0.6 to 1.3 and a water content of less than 100 ppm by weight;

b) cooling the filaments by means of air flowing perpendicularly to the filaments at a velocity in the range of 0.2 to 0.8 m/sec.;

c) coating the filaments with a spin finish;

d) heating the filaments to a temperature greater than the glass transition temperature of the filaments, but less than 200° C. prior to drawing the filaments;

e) drawing the filaments between a set of feed rolls and a set of draw rolls to a draw ratio high enough that the break elongation of the drawn filaments is between 10 to 90%, the temperature of the draw rolls being from 120° to 200° C.;

f) feeding the drawn filaments from the draw rolls at a speed of at least 800 m/min. to a bulking unit in which the filaments are blown and deformed in three dimensions with hot bulking fluid having a temperature at least as high as that of the draw rolls to form bulked continuous filaments having randomly spaced curvilinear crimp;

g) cooling the bulked continuous filaments to a temperature less than the glass transition temperature of the filaments; and h) winding up the filaments at a speed at least 10% lower than that of the draw rolls.

DETAILED DESCRIPTION OF THE INVENTION

Figure 1:
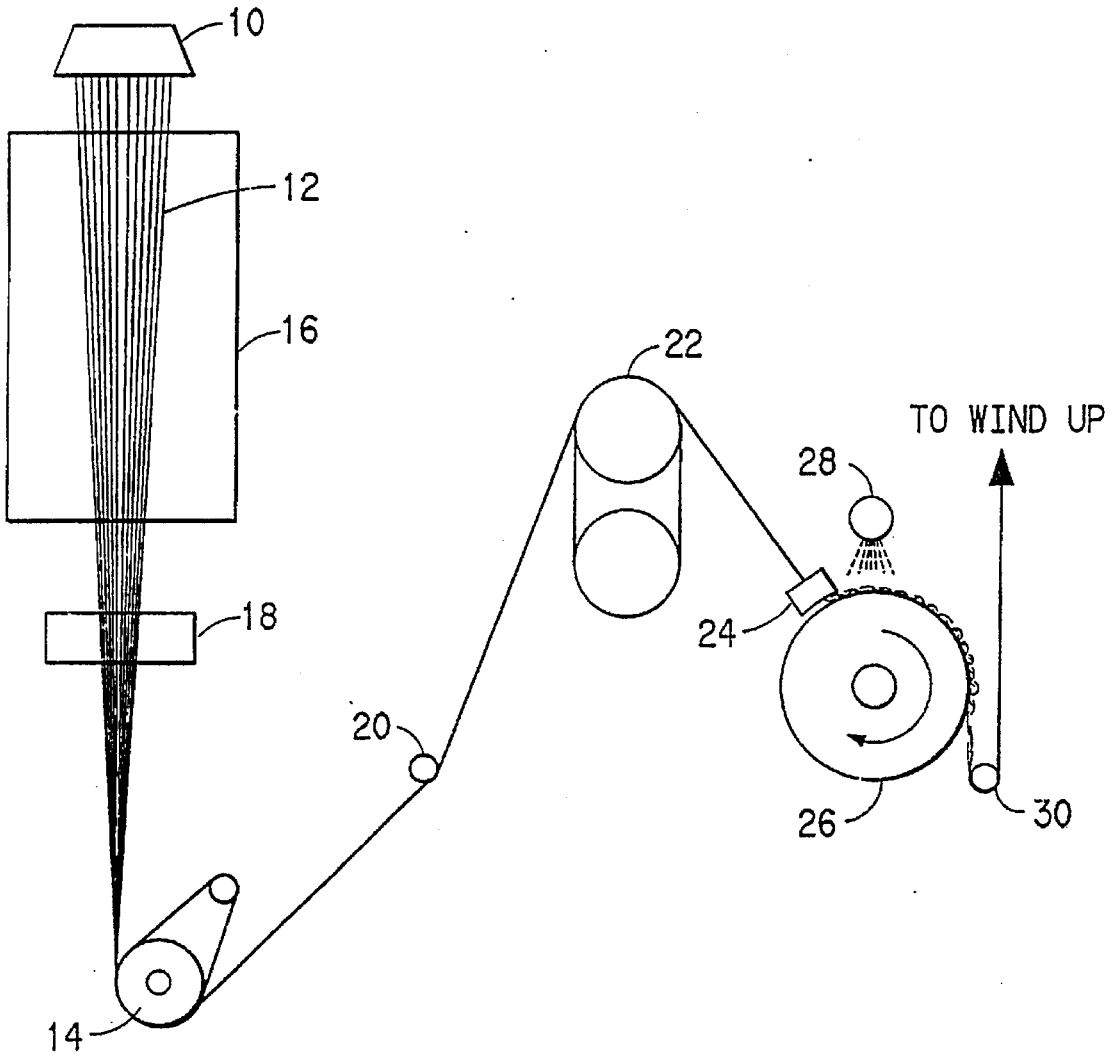
FIG. 1 is a schematic diagram of an embodiment of this invention wherein a heated feed roll is used to raise the temperature of the filaments above the glass transition temperature prior to drawing.

FIG. 1 illustrates a method for manufacturing bulked continuous filaments of poly(trimethylene terephthalate). Poly(trimethylene terephthalate) polymer having an intrinsic viscosity of 0.6 to 1.3, preferably 0.8 to 1.1 and a water content less than about 100 ppm is extruded at a temperature between 245° to 285° C. through spinneret 10 to form filaments 12 which are pulled by feed roll 14 through quench chimney 16 where the filaments are cooled by a radial flow or cross flow of gas, typically humidified air at a temperature between 10° to 30° C. and at a velocity between 0.2–0.8 m/sec. Prior to feed rolls 14, a spin finish is applied to the filaments by finish applicator 18.

It is critical that the filaments be at a temperature above their glass transition temperature (Tg) and below 200° C. prior to drawing. Non-uniform drawing and yarn breakage results when drawing below the Tg. Above 200° C. is too close to the yarn melting point to effectively orient the molecules. The glass transition temperature of poly (trimethylene terephthalate filaments varies between about 35°–50° C. depending upon the moisture content of the filaments, the exact polymer composition and processing conditions such as quenching. In the process shown in FIG. 1, feed rolls 14 may be heated to a temperature between the glass transition temperature and 200° C. in order to heat the filaments for drawing. In an alternate embodiment, feed rolls 14 may be at room temperature and a heated draw pin (not shown), located between the feed rolls and draw rolls 22 may be used to heat the filaments to a temperature between the filament glass transition temperature and 200° C. prior to drawing.

Figure 2:
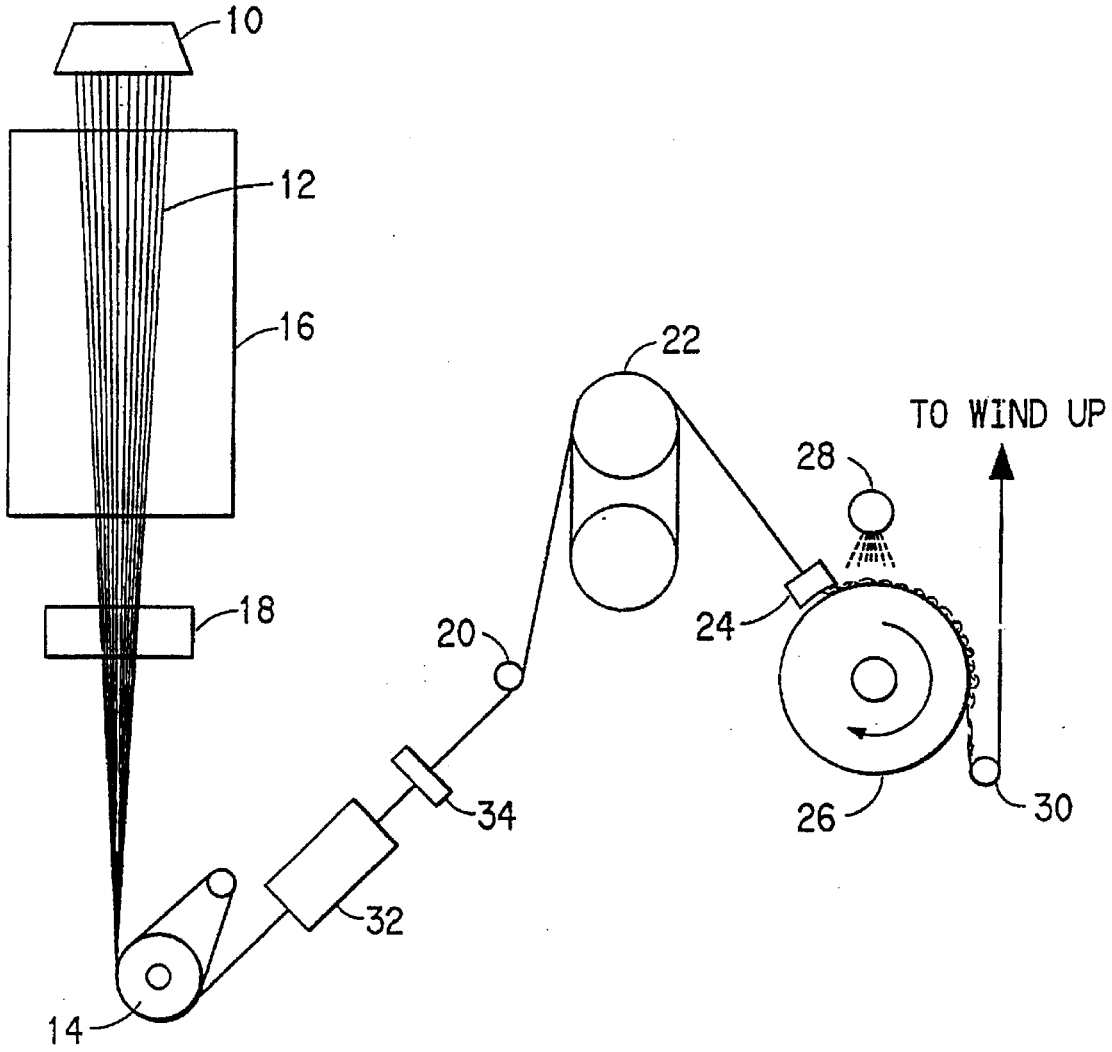
FIG. 2 is a schematic diagram of an embodiment of this invention wherein a steam draw assist jet is used to preheat the filaments prior to drawing.

A preferred embodiment is shown in FIG. 2 where a hot fluid draw assist jet 32 is used to heat the filaments to a temperature between their glass transition temperature and 200° C. The hot fluid may be air or steam. When a steam jet is used, a large amount of finish is removed from the filaments and it is necessary to apply a post draw finish with applicator 34.

Filaments then pass over optional change of direction pin 20 and then draw rolls 22 which are maintained at a temperature between 120° to 200° C. to promote annealing. The temperature must be at least about 120° C. in order to heat the yarn for bulking. Heating the yarn above about 200° C. may cause it to melt onto the hot rolls. The draw ratio of the filaments is controlled by adjusting the speeds of the feed rolls and/or the draw rolls until the break elongation of the filaments is between 10 to 90 percent, preferably 20–70%. This typically corresponds to a draw ratio between about 3 to 4.5.

The draw rolls 22 deliver the filaments to a jet bulking unit 24 such as that described in U.S. Pat. No. 3,525,134 (the disclosure of which is hereby incorporated by reference) where the filaments are blown and deformed in three directions with hot bulking fluid such as air or steam. The hot fluid must be at a temperature of at least that of the draw rolls 22, preferably between 120° to 220° C.

The resultant bulked continuous filament (BCF) yarn, having randomly spaced 3-dimensional curvilinear crimp, is then cooled below the glass transition temperature of the filaments while the yarn is in a state of approximately 0 gpd tension so as not to pull out a significant amount of crimp. Cooling may be accomplished by a variety of commercially available means. In a preferred embodiment, the BCF yarn is ejected from bulking unit 24 onto a rotating drum 26 having a perforated surface through which air is suctioned. To aid in cooling, an optional mist quench 28 of water may be used. Filaments then pass over roll 30 and are wound up at a speed of at least 10% less than that of the draw rolls. The wind-up speed is kept at least about 10% less than that of the draw rolls because running at a higher speed would cause crimp development to decrease and yarn shrinkage to increase.

In the bulking unit described in U.S. Pat. No. 3,525,134, the filaments are both bulked and entangled. When other bulking units are used, a separate entangling step may be necessary prior to wind up. Any method common in the trade may be used to entangle the yarn.

Combining the spinning, drawing and texturing steps into a single process as described in the preceding embodiments offers high productivity and gives a uniform, reproducible yarn. Of course the steps described above may also be used in a split process as well.

The bulked continuous filament yarns of this invention have an intrinsic viscosity between 0.6 to 1.3, a boil off BCE between 20 to 95 percent, a shrinkage from 0 to 5 percent, a denier per filament between 4 and 25 and a total denier between 700 and 5000. Tenacity is in the range of 1.2 to 3.5 gpd and break elongation is between 10 to 90 percent, preferably 20 to 70 percent. Although these BCF yarns are particularly useful in carpets, their end uses could also include upholstery and wall covering. The yarns have excellent bending recovery (as defined in the Test Methods below) of at least 65% while BCF yarn of poly(ethylene terephthalate) has a recovery less than about 40% and BCF yarn of poly(butylene terephthalate) is less than about 60%. Bending recovery is indicative of how well a yarn can bounce back to its original geometry after a load has been removed. The higher the percent recovery, the more the yarn is able to return to its original geometry. In the case of carpet, high bending recovery implies good crush resistance (pile height retention).

In addition to their superior bending properties, the random 3-dimensional curvilinear crimp BCF yarns of the present invention are especially useful in carpets due to the nature of the crimp. These curvilinear crimped yarns have high crimp permanence. Yarns having other forms of crimp such as asymmetrically quenched helical crimp, may have a low crimp regeneration force (or crimp permanence) so that crimp is permanently pulled out during normal carpet manufacturing steps. Little curvilinear crimp is permanently pulled out of the yarns of this invention during carpet manufacture. Also, yarns having random 3-dimensional curvilinear crimp are unable to stack on top of each other. Non-randomly crimped yarns can stack on top of each other (sometimes referred to as "follow the leader"). This stacking causes there to be less bulk in the resulting carpet pile and thus more yarn is required to provide a desired cover.

Carpets made from the BCF yarns of this invention may be made in any of the manners known to those skilled in the art. Typically, a number of yarns are cable twisted together (about 3.5 to 6.5 twists per inch) and heat set (about 270° to 290° F.) in a device such as an autoclave, suessen or Superba(R) and then tufted into a primary backing. Latex adhesive and a secondary backing are then applied. Cut pile style carpets having a pile height between about 0.25 to 1 inches or loop pile style carpets having a pile height between about 0.125 to 0.375 inches can be made with these BCF yarns. Typical carpet weights are between about 25 to 90 ounces per square yard.

Surprisingly, carpets of this invention have superior texture retention (as defined in the test method below) of at least 4.0 and pile height retention (as defined in the test method below) of at least 90%, preferably at least 95%, and a stain rating of at least 4.0. Carpets of similar construction and yarns except of poly(ethylene terephthalate) have texture retentions less than 3.5 and pile height retentions less than 90% with a stain rating of about 3.5. Carpets of similar construction and yarns except of poly(butylene terephthalate) have texture retention less than 2.0 and pile height retention less than 90% with a stain rating of about 4.

TEST METHODS

Intrinsic Viscosity

This is the viscosity of a 0.32 percent by weight solution of polyester polymer or yarn in a mixed solvent of 25 parts trifluoroacetic acid and 75 parts methylene chloride (volume/volume) measured in an Ostwald-Cannon-Fenske series 50 viscometer at 25° C.

Boil Off Bundle Crimp Elongation (BCE)

Bundle crimp elongation (BCE) is the amount a boiled-off, conditioned yarn sample extends under 0.10 grams/denier tension, expressed as percent of the sample length without tension. In the boil-off procedure, a yarn sample length of about 1 meter is coiled in a relaxed condition into a 10 cm diameter perforated can, and then immersed for three minutes in rapidly boiling water at 100° C. The sample and can are then removed from the water and dipped into and out of room temperature water to cool the sample. The sample is then centrifuged to remove excess water, dried in a hot-air oven at 100° to 110° C. for one hour and then conditioned for at least an hour prior to measurement of BCE.

A 50 cm. length (L1) of the test sample in a relaxed condition is mounted in a vertical position. The sample is then extended by gently hanging a weight on the yarn to produce a tension of 0.10±0.02 gram/denier. The extended length (L2) is read after the tension has been applied for at least three minutes. BCE, in percent, is then calculated as 100 (L2-L1)/L1. Results are normally reported as averages of three tests per sample.

Shrinkage

Shrinkage is the change in extended length of yarn or fiber which occurs when the yarn or fiber is treated in a relaxed condition in boiling Water at 100° C. To determine continuous filament yarn shrinkage, a piece of conditioned yarn sample is tied to form a loop of between 65 and 75 cm length. The loop is hung on a hook on a meter board and a 125-gram weight is suspended from the other end of the loop. The length of the loop is measured to give the before boil-off length (L1). The weight is then removed from the loop. The sample is loosely wrapped in an open-weave cloth (e.g., cheese cloth), placed in 100° C. boiling water for 20 minutes, removed from the water, centrifuged, removed from the cloth and allowed to hang-dry at room conditions prior to undergoing the usual conditioning before further measurement. The dried, conditioned loop is then rehung on the meter board, the 125-gram weight is replaced, and the length of the loop measured as before to give the after boil-off length (L2). The yarn shrinkage, expressed as a percent, is then calculated as 100 (L1-L2)/L1, and as reported herein is the average of three such measurements for a given yarn.

Bending Recovery

This test provides information on the recovery property of fiber. The technique used is described by Prevorsek, Butler and Lamb (*Tex. Res. J.* February, 1975, PP. 60–67). In this test, the yarn is hung over a wire of 0.003 inch diameter under a load of 800 mg on each end of the yarn for 60 seconds. The test is performed at 24° C. and at 57% relative humidity (RH). The filament is then removed and the amount of "recovery" is immediately measured. A value of 0 degrees would be no recovery. A value of 180 degrees corresponds to complete recovery.

Staining Test

A sample approximately 6 inches by 6 inches is cut from a carpet. A staining agent of hot (about 50° C.) coffee is used. The carpet sample is placed on a flat, non-absorbent surface; 20 ml of the coffee staining agent is poured onto the sample from a height of 12 inches above the carpet surface and the sample is then left undisturbed for 24 hours. To confine the stain, a cylinder of approximately 2 inches in diameter may be placed on the carpet and the staining agent may be poured through it.

Excess stain is blotted with a clean white cloth or clean white paper towel or scooped up as much as possible. Blotting is always performed from the outer edge of the spill towards the middle to keep the spill from spreading. Cold water is applied with a clean white cloth or a sponge over the stained area, gently rubbing against the pile from left to right and then reversing the direction from right to left. The excess is blotted.

A detergent cleaning solution (15 g of TIDE detergent mixed in 1000 ml of water and allowed to reach room temperature prior to use) is applied with a clean white cloth or sponge directly on the stain, gently rubbing the pile from left to right and then reversing direction from right to left. The entire stain is treated all the way to the bottom of the pile and then the blotting is repeated.

The cold water treatment is repeated, and the carpet is blotted thoroughly to remove the stain and the cleaning solution.

The cold water and detergent cleaning steps are repeated until the stain is no longer visible or until no further progress in removing the stain can be achieved. The carpet is blotted completely to absorb all the moisture.

The stain resistance of the carpet is visually determined by the amount of color left in the stained area of the carpet after this cleaning treatment. The scale used is 5=no staining
4=slight staining
3=noticeable staining
2=considerable staining
1=heavy staining.

Texture Retention

The texture retention data are obtained by subjecting the test carpets to 11,000 cycles of human traffics and visually determining a rating based on the degree of matting versus a set of control samples. The texture retention is reported on a scale of 1 to 5 with a rating of 5 corresponding to an untested control sample, 4 corresponding to a lightly worn sample, 3 to a moderately worn sample, 2.5 to the turning point from acceptable to unacceptable wear, 2 corresponding to clearly unacceptable wear, and 1 corresponding to an extremely matted sample.

Pile Height Retention

The percent pile height retention is 100 times the ratio of the pile height of carpet tufts after 11,000 traffics to the pile height of the carpet tufts before traffics.

EXAMPLES

Example 1

Poly(trimethylene terephthalate) polymer having an intrinsic viscosity of 0.90 and less than 50 ppm moisture was spun through a 160 hole spinneret into two segments, each of 80 filaments having a trilobal cross section with a modification ratio (MR) of 1.7. The polymer temperature before the spinning pack was controlled at about 260°±1° C. and spinning throughput was 335 grams per minute. The molten filaments were then rapidly quenched in a chimney, where cooling air at 10° C. was blown past the filaments at 300 cubic ft./min (0.236 cubic m/sec). The filaments were pulled by an unheated feed roll rotating at a surface speed of 630 yd./min through the quench zone and then were coated with a lubricant for drawing and crimping. The coated yarns were passed through a steam draw jet, a post draw jet finish applicator and onto a pair of heated draw rolls which rotated at 2177 yd./min (3.45 X draw ratio). The temperature in the draw jet was 200° C. and the draw roll temperature was 180° C. The yarns were then forwarded into a dual-impingement bulking jet (195° C. hot air), similar to that described in Coon, U.S. Pat. No. 3,525,134, to form two 1200 denier, 15 denier per filament (dpf) bulked continuous filament yarns. Yarns had a shrinkage=2.44%, tenacity=2.08 grams per denier (gpd), elongation=20.5%, modulus=53.68 gpd and a boil off BCE=57.6%.

Before determining bending recovery, the yarns were ply twisted (4×4) and heatset in an autoclave at 280° F. Bending recovery data are shown on Table I.

Example 2 (comparative)

A commercial grade poly(ethylene terephthalate) polymer, code 1914F available from Du Pont, was spun into 1200 denier, 15 dpf, 1.7 MR trilobal cross section yarn using the process described in Example 1 except that no post draw jet finish application was necessary. The spinning (290° C.), draw roll (190° C.) and bulking jet (220° C.) temperatures were also higher than in Example 1 due to the higher melting temperature of poly(ethylene terephthalate) versus that of poly(trimethylene terephthalate). The yarn had a shrinkage=4.11%, tenacity=3.63 gpd, elongation=27.8%, modulus=45.90 gpd and a boil off BCE=66.3%.

Bending recovery data for the ply twisted, heatset yarns are shown in Table I.

Example 3 (comparative)

A commercial grade poly(butylene terephthalate) polymer, RYNITE 6131 available from DuPont, was spun into 1200 denier, 15 dpf, 1.7 MR trilobal cross section yarn using the process described in Example 1 except without the steam heated draw assist jet and post draw jet finish application. The spinning temperature was slightly lower (247° C.) due to the lower polymer melting temperature. Yarn had a shrinkage=3.04%, tenacity=2.79 gpd, elongation=12.8, modulus=43.07 gpd, and a boil off BCE=74.6%

Bending recovery data for the ply-twisted heatset yarns are shown in Table I.

TABLE I

| Sample | Recovery |
|---|---|
| Example 1 | 119.4 |
| Example 2 | 71.3 |
| Example 3 | 107.9 |

The data in Table I show that the poly(trimethylene terephthalate) BCF yarns of Example 1 have greater bending recovery than the yarns of Example 2 [poly(ethylene terephthalate)] or Example 3 [poly(butylene terephthalate)]. Therefore, the yarns of Example 1 should have better pile height retention (crush resistance) in carpets.

Example 4

The test yarns produced in Examples 1, 2 and 3 were cable twisted 4×4 twist per inch, autoclave heatset at 280° F. and tufted into ⅝ inch pile height, 40 oz. per square yard cut pile carpets on a ⅛ inch gauge tufting machine. The carpets were Beck dyed in medium blue color with disperse dyes. The carpets made from yarns of Examples 1 and 2 had good pin point tuft definition. Carpet made from yarns of Example 3 had very poor tuft definition. It looked like a felt instead of saxony carpet. The texture retention, pile height retention and staining test results are shown in Table II.

TABLE II

| Carpet Yarn | Texture Rating | Pile Height Retention | Stain Rating |
|---|---|---|---|
| Example 1 | 4.0 | 97% | 4.5 |
| Example 2 | 3.4 | 89% | 3.5 |
| Example 3 | 2.0 | 89% | 4.0 |

Surprisingly, carpets made from the poly(trimethylene terephthalate) BCF yarns of Example 1 have significantly better texture retention and pile height retention than carpets of either poly(ethylene terephthalate) (Example 2) or poly (butylene terephthalate) (Example 3) yarns.

We claim:

1. A process for the production of poly(trimethylene terephthalate) bulked continuous filaments comprising the steps of:

a) extruding molten poly(trimethylene terephthalate) polymer at a temperature from 245° C. to 285° C. through a spinneret to form filaments, said poly (trimethylene terephthalate) polymer having an intrinsic viscosity in the range of 0.6 to 1.3 and a water content of less than 100 ppm by weight;

b) cooling the filaments in a quench chimney by means of air flowing perpendicularly to the filaments at a velocity in the range of 0.2 to 0.8 m/sec.;

c) coating the filaments with a spin finish;

d) heating the filaments to a temperature greater than the glass transition temperature of the filaments, but less than 200° C. prior to drawing the filaments;

e) drawing the filaments between a set of feed rolls and a set of draw rolls to a draw ratio high enough that the break elongation of the drawn filaments is between 10 to 90%, the temperature of the draw rolls being from 120° to 200° C.;

f) feeding the drawn filaments from the draw rolls at a speed of at least 800 m/min. to a hot-fluid jet bulking unit in which the filaments are blown and deformed in three dimensions with hot bulking fluid having a temperature at least as high as that of the draw rolls to form bulked continuous filaments having random 3-dimensional curvilinear crimp;

g) cooling the bulked continuous filaments to a temperature less than the glass transition temperature of the filaments;

h) winding up the filaments at a speed at least 10% lower than that of the draw rolls.

2. The process of claim 1 wherein the filaments are heated for drawing by a heating means located between the feed rolls and the draw rolls and wherein the temperature of the feed rolls is less than the glass transition temperature of the filaments.

3. The process of claim 2 wherein said heating means is a hot fluid jet.

4. The process of claim 3 wherein the hot fluid is steam and further comprising the step of coating the drawn filaments with a post draw finish prior to feeding the drawn filaments to the bulking unit.

5. The process of claim 2 wherein said heating means is a heated draw pin.

6. The process of claim 1 wherein the filaments are heated for drawing by setting the temperature of the feed rolls to a temperature greater than the glass transition temperature of the filaments, but less than 200° C.

7. The process of claim 1 wherein the filaments are drawn to a draw ratio high enough that the break elongation of the filaments is between 20 to 70%.

8. The process of claim 1 wherein the temperature of the bulking fluid is between 120° to 220° C.

9. The process of claim 1 wherein prior to wind up the bulked continuous filaments are cooled below the filament glass transition temperature on a rotating drum having a perforated surface through which air is suctioned.

10. The process of claim 1 further comprising the step of entangling the bulked continuous filaments after the filaments have been cooled below their glass transition temperature and prior to wind up.

* * * * *